US008727409B2

(12) United States Patent
McCambridge

(10) Patent No.: US 8,727,409 B2
(45) Date of Patent: May 20, 2014

(54) COMB CADDY

(75) Inventor: James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 329 days.

(21) Appl. No.: 13/272,645

(22) Filed: Oct. 13, 2011

(65) Prior Publication Data

US 2013/0092594 A1 Apr. 18, 2013

(51) Int. Cl.
*A45C 11/00* (2006.01)
*A45D 44/00* (2006.01)

(52) U.S. Cl.
USPC ..... 294/143; 294/137

(58) Field of Classification Search
USPC ..... 294/143, 137, 141, 142; D28/74; 206/234, 581; 30/200, 201, 213.1
See application file for complete search history.

(56) References Cited

U.S. PATENT DOCUMENTS

| | | | | | |
|---|---|---|---|---|---|
| 1,928,594 | A | * | 9/1933 | Kearney | 312/283 |
| 4,173,285 | A | * | 11/1979 | Kiraly et al. | 206/356 |
| 5,131,418 | A | * | 7/1992 | Vaccaro | 132/213.1 |
| 5,937,526 | A | * | 8/1999 | Wahl et al. | 30/201 |
| 5,975,290 | A | | 11/1999 | Lowe | |
| D545,500 | S | | 6/2007 | McCambridge | |
| D548,888 | S | * | 8/2007 | McCambridge | D28/74 |
| 8,528,216 | B2 | * | 9/2013 | Melton et al. | 30/233.5 |
| 2009/0218252 | A1 | * | 9/2009 | Michel | 206/581 |

* cited by examiner

*Primary Examiner* — Paul T Chin
(74) *Attorney, Agent, or Firm* — Greer, Burns & Crain, Ltd.

(57) ABSTRACT

A comb holder for removably holding at least one hair clipper attachment comb, includes a frame including a first end, a second end, a first side, a second side, and having at least two elongate beams each defining one of the sides and spaced from each other, a plurality of transverse baffles having ends engaging at least one of the beams to define a plurality of open cavities between the beams, and the cavities being constructed and arranged for accommodating at least one tooth of the at least one attachment comb.

16 Claims, 10 Drawing Sheets

COMB CADDY

BACKGROUND

The present invention relates generally to a storage and organization device, and more particularity to a holder for storing and organizing attachment combs in a compact, readily accessible position for use during hair cutting.

Attachment combs are commonly used with powered hair cutting devices such as clippers or trimmers collectively referred to as hair clippers. Conventional hair clippers often are supplied with multiple attachment combs of varying sizes. Each size of comb has a plurality of teeth, and the length of the teeth vary from comb to comb, and all combs of a set typically attach to the clipper near the blades using a snap or friction fit. An operator typically changes attachment combs several times over the course of a haircut or hair styling event, depending on the desired length of hair. When a comb is not in use, the comb is typically placed on a nearby surface in an unorganized fashion. The act of searching though a multitude of combs to find the proper size during the course of a haircut can unduly increase the amount of time needed to complete the haircut.

The use of storage devices for hair clipper attachment combs is known in the prior art. One such device is disclosed in Lowe, U.S. Pat. No. 5,975,290. This device contains a rectangular leather or fabric panel with pockets for storing hair clipper blades and guards. A disadvantage of this configuration is that the operator does not have ready access to a particular hair comb because this storage device provides no identification system for determining which comb is in a particular pocket. A second disadvantage of the prior art device is that it is configured to be hung on a wall or similar vertical surface. Because hair cutting usually takes place adjacent to a mirror or counter in professional settings, or in a bathroom or near a kitchen table in home settings, there is often little space to hang a panel with sufficient storage capacity for a plurality of hair clipper combs. Also, in home environments, wall storage is not usually considered aesthetically pleasing.

Another preferred design criteria of attachment combs and their organization is that during the cutting operation, combs should be located on a table or counter within easy reach of the operator. Conventional counter-supported attachment comb holders are known that are rigid, and include a plurality of compartments configured for accommodating corresponding attachment combs. However, in some cases, such organizers unduly contribute to the bulk of the clipper assembly package. Also, such bulky packages are more expensive to ship and handle.

Accordingly, there exists a need for an improved attachment comb storage device that holds and organizes attachment combs in a compact, readily accessible position for use during hair cutting. There is also a need for an improved attachment comb storage device that is relatively inexpensive to manufacture and compact enough to be packaged with the clipper assembly.

SUMMARY

The present comb caddy or comb attachment storage device meets or exceeds the above-listed needs. Specifically, the present device lays relatively flat when not in use, which allows compact packaging and shipping, and upon assembly, is configured for organizing and displaying a set of attachment combs. Additionally, the instant device provides ready visibility of, and accessibility to combs when located on a countertop or tabletop. Further, the present storage device allows for the sequential arrangement of attachment combs in size order, which allows the operator to easily locate a particular comb.

In a preferred embodiment, the combs are held in the caddy at an angle which facilitates easy visibility of the comb size-identifying number. Also, the present caddy engages the combs with a sliding fit at a comb base panel, and also includes cavities dimensioned for accommodating multiple comb teeth to further stabilize the comb in the caddy. This organizing scheme also allows the operator to easily keep track of the attachment combs in a set to prevent them from becoming lost. Finally, the present device includes a handle to facilitate the movement of the comb set as a unit if desired.

More, specifically, a comb holder for removably holding at least one hair clipper attachment comb includes a frame including a first end, a second end, a first side, a second side, and having at least two elongate beams each defining one of the sides and spaced from each other to define a plurality of open cavities therebetween, a plurality of transverse baffles having ends engaging at least one of the beams to further define the cavities, and the cavities being constructed and arranged for accommodating at least one tooth of the at least one attachment comb.

In an alternate embodiment, a comb holder for use with a plurality of hair clipper attachment combs is provided and includes a frame including at least two elongate beams with a center beam disposed therebetween, the beams being in spaced, parallel relationship to each other, a plurality of transverse baffles separating the center beam respectively from each of the elongate beams for defining a plurality of open cavities between the center beam and each elongate beam, the cavities being constructed and arranged for accommodating at least one tooth of one of the attachment combs. A plurality of angled slots is provided and each slot has open ends along an upper edge of each elongate beam for accommodating an attachment comb base.

In still another embodiment, a comb attachment set and comb holder assembly is provided, including a plurality of attachment combs, each having a plurality of teeth attached at one end to a base panel. A comb holder frame has at least two elongate beams with a center beam disposed therebetween, the beams being in spaced, parallel relationship to each other. A plurality of transverse baffles separate the center beam respectively from each of the elongate beams for defining a plurality of open cavities between the center beam and each elongate beam. The cavities are constructed and arranged for accommodating at least one tooth of one of the attachment combs. A plurality of angled slots having open ends along an upper edge are provided in each elongate beam for accommodating a corresponding attachment comb base.

DETAILED DESCRIPTION

Figure 1:
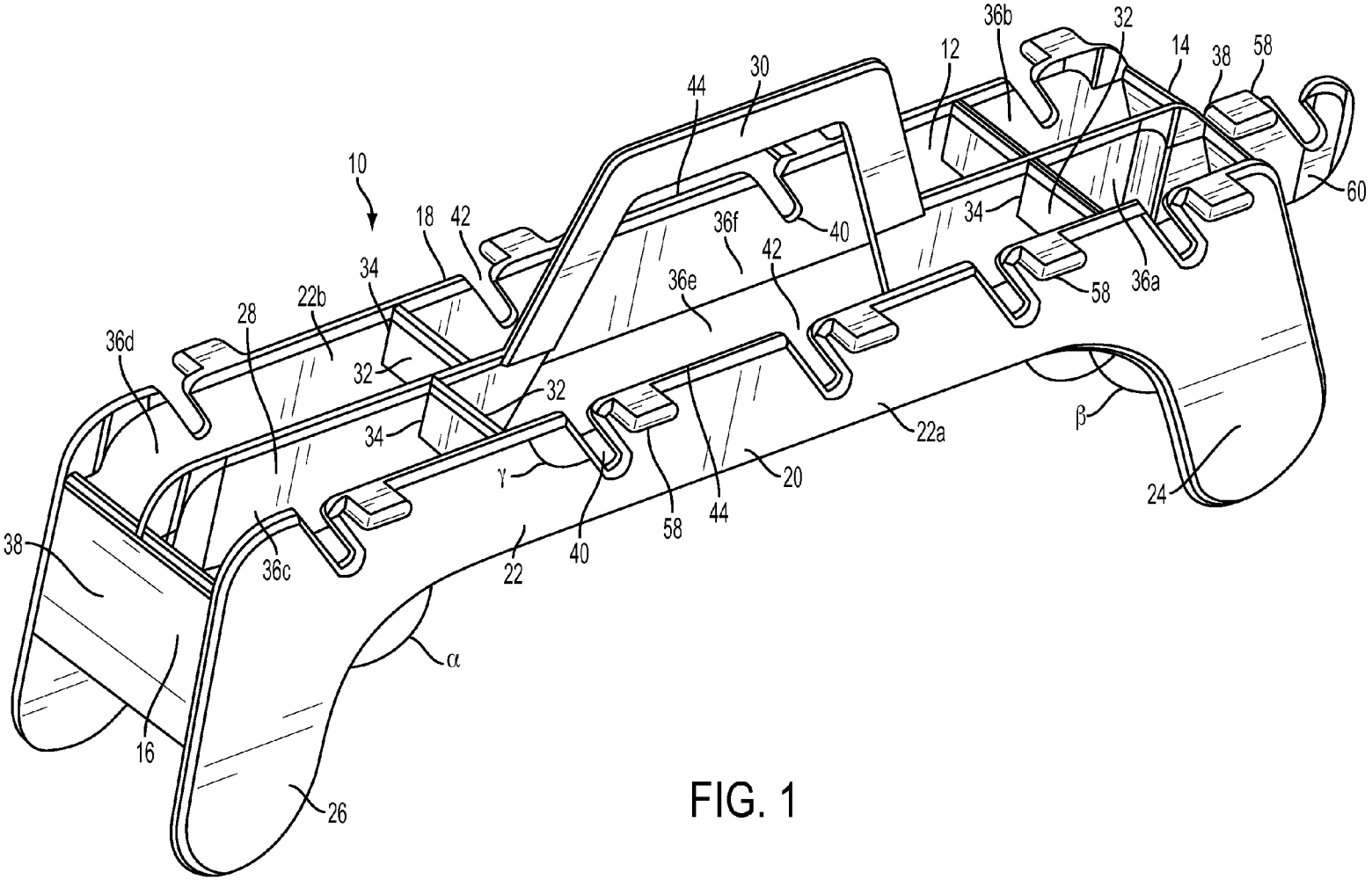
FIG. 1 is a top perspective view of the present attachment comb holder.
Figure 2:
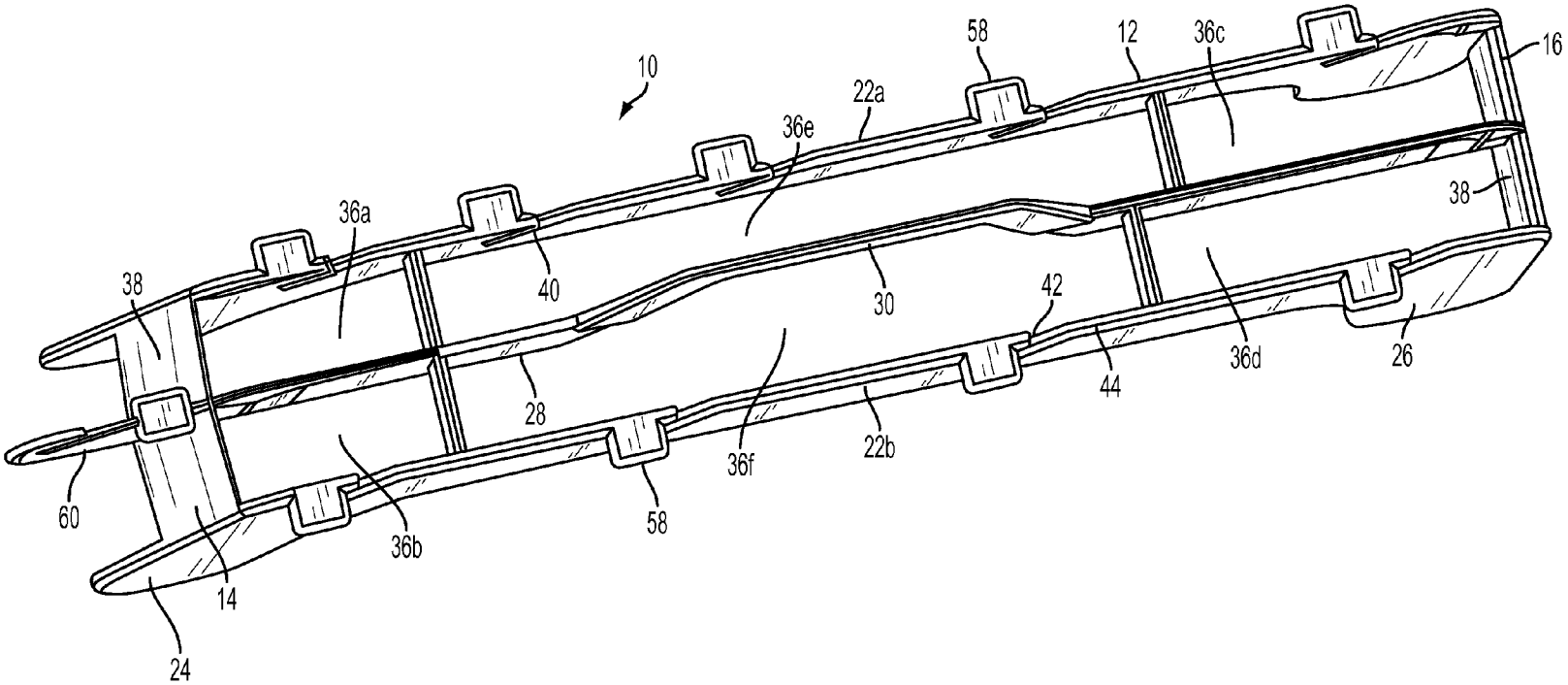
FIG. 2 is a top plan/perspective view of the comb holder of FIG. 1.
Figure 3:
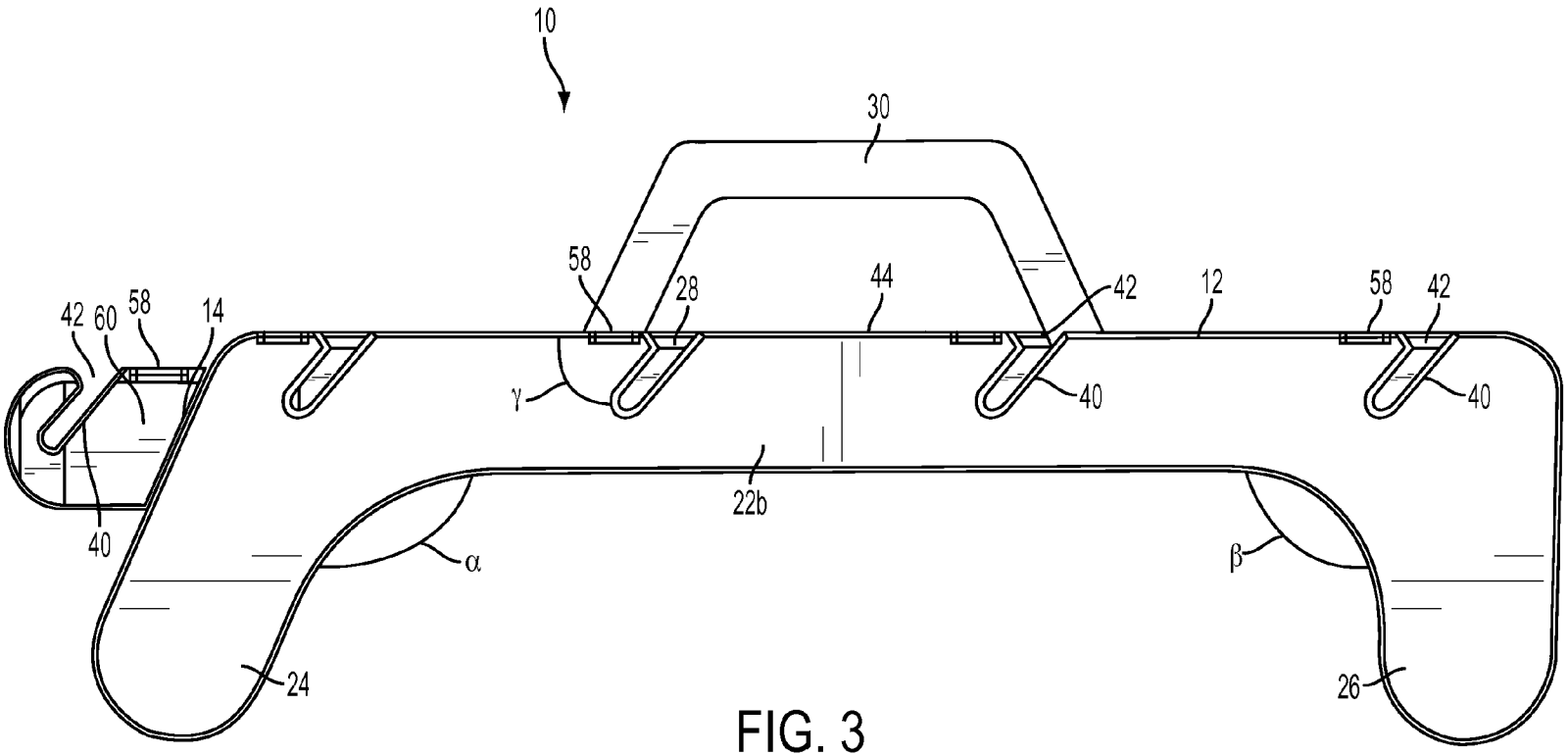
FIG. 3 is a reverse side elevation of the comb holder of FIG. 1.

Referring now to FIGS. 1-3, a comb holder or caddy for removably holding at least one and preferably a set of hair clipper attachment combs is generally designated 10 and includes an elongate frame 12 having a first end 14 and an opposite second end 16, as well as a first side 18 and a second side 20. When viewed from the side, the frame 12 forms a generally inverted "U"-shape defined by one of two elongate beams 22, each defining one of the sides 18, 20. Preferably, the beams 22 are relatively planar and each have a depending foot formation 24, 26 projecting respectively from the first and second ends 14, 16. It will be seen from FIG. 3 that the first end foot 24 extends at an angle α from the corresponding elongate side beam 22 which is distinct from an angle β of extension of the foot formation 26 at the second end 16. While other angles are contemplated, in the preferred embodiment, α is an oblique angle, and β is a right angle.

The frame 12 includes a center beam 28 disposed between the two elongate beams 22*a*, 22*b*, which are generally identical in construction. For facilitating carrying the holder 10, the frame 12, and preferably the center beam 28 is provided with a handle 30. All of the beams 22, 28 are disposed in spaced, parallel relationship to each other. This spacing is maintained, and structural support is provided by a plurality of transverse support walls or baffles 32.

Figure 4:
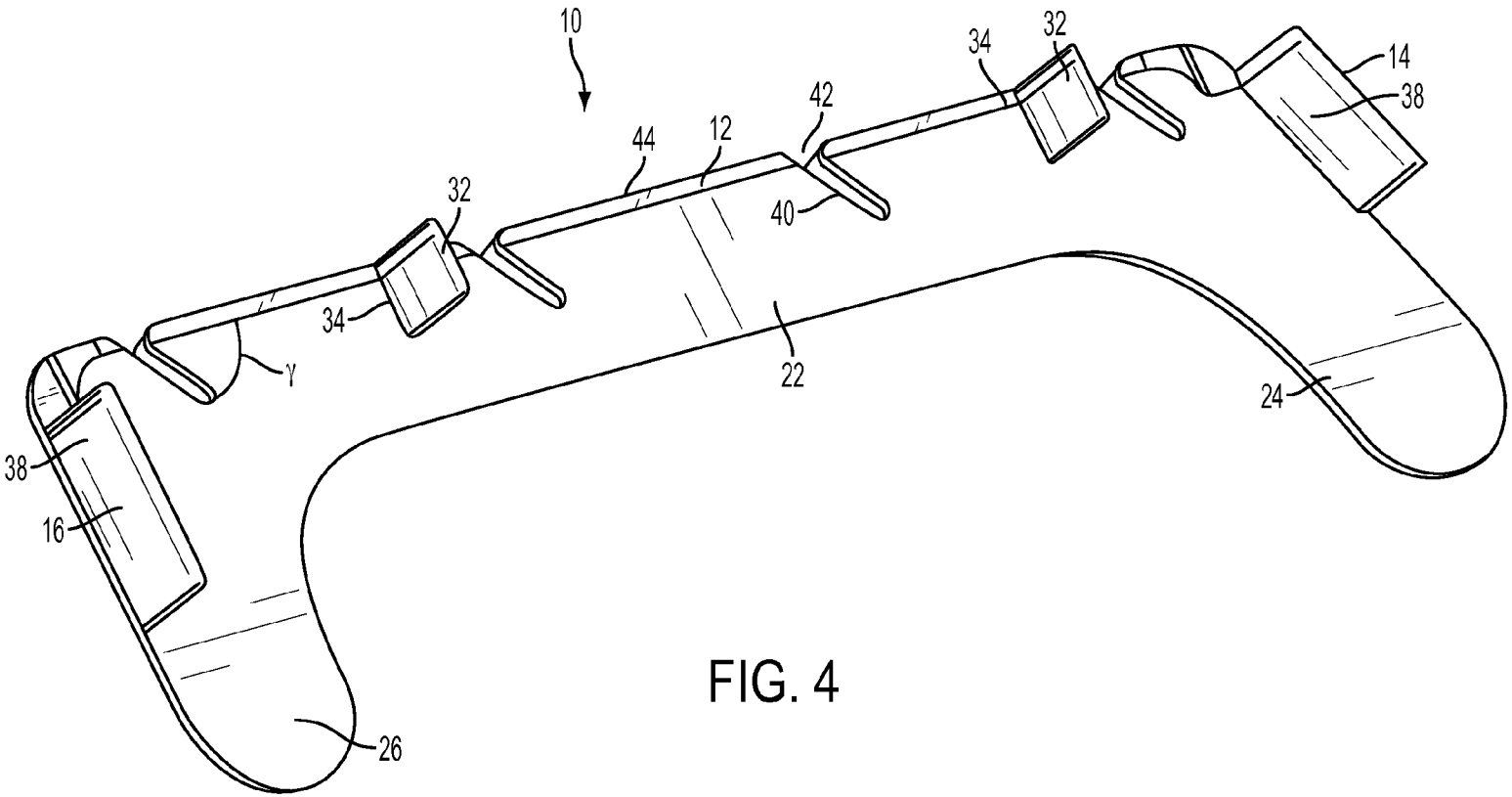
FIG. 4 is a fragmentary side perspective view of the present comb holder.

Referring now to FIGS. 1, 2 and 4, the transverse baffles having ends 34 engaging at least one of said beams 22*a*, 22*b*, and 28 to define a plurality of open cavities 36 between the beams. In other words, the baffles 32 separate the center beam 28 respectively from each of the side beams 22*a*, 22*b* to define the cavities 36. By designating the cavities 36 as "open" refers to the fact that they are open on top and bottom margins, and are defined only by the beams 22, 28 the baffles 32 and end walls 38 discussed below. This open, framework construction of the holder 10 results in a lightweight, inexpensive unit that lies relatively flat on its side for easy and efficient shipping. Also, the open framework construction has the capacity to hold a large number of attachment combs for the size of the frame 12, as discussed below. While other methods of fabrication and materials are contemplated, in the preferred embodiment, the frame 12, including the beams 22, 28 and the baffles 32 is integrally formed of molded plastic. Also as best seen in FIG. 2, the cavities 36*a* and 36*b* closer to the first end 14 are similar in size, while the cavities 36*c*, 36*d* closer to the second end 16 are relatively larger than the cavities 36*a*, 36*b* and are different in size from each other, with 36*c* being smaller than 36*d*. Closer to the handle 30 are central cavities 36*e*, 36*f*, which are the largest in size and are different in size from each other, with 36*e* being larger than 36*f*. As will be described in further detail below, the cavities 36 are constructed and arranged for accommodating at least one tooth of at least one attachment comb. To further strengthen the frame 12, transverse end walls 38 at the first and second ends 14, 16 connect respective first and second ends of the beams 22, 28 and are also created in the preferred integral forming process in which the frame is formed.

Figure 5:
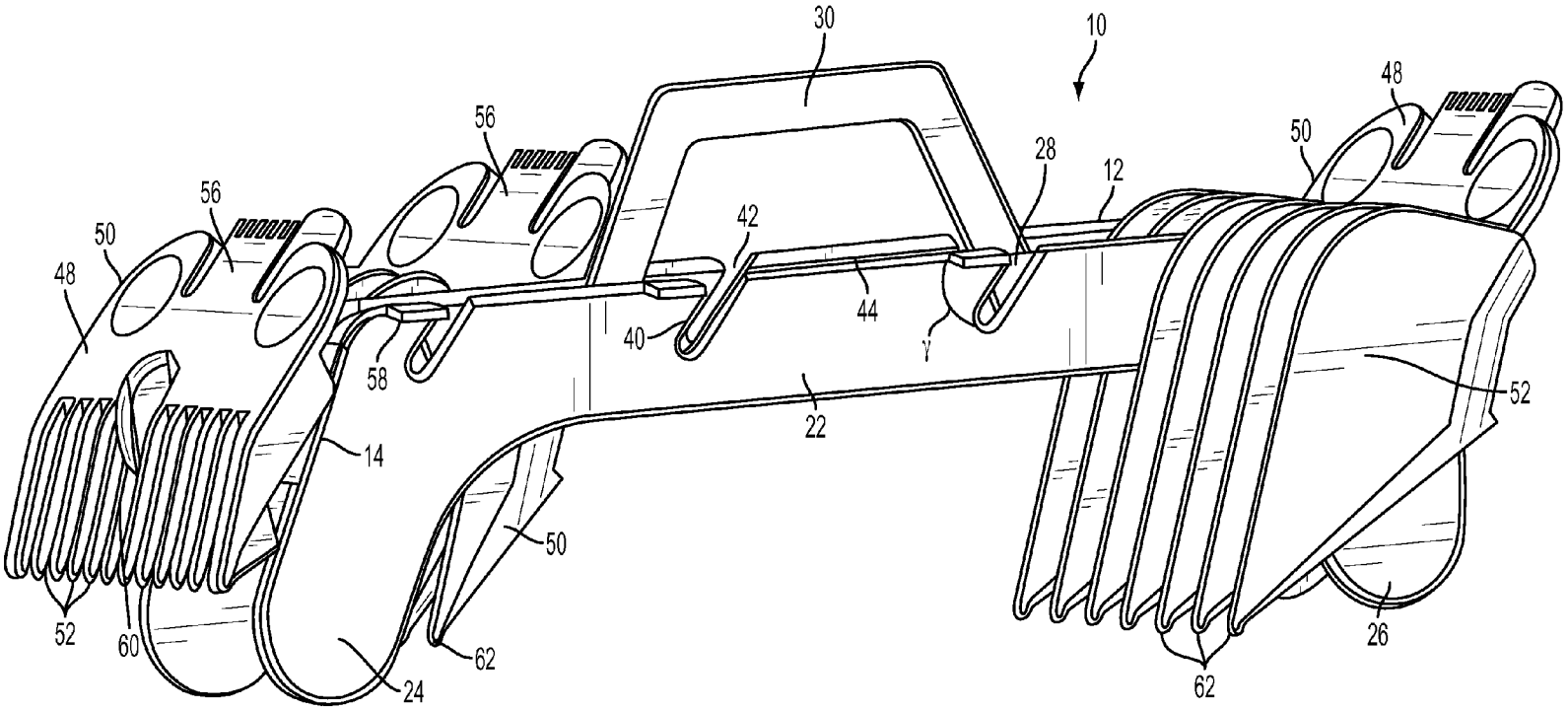
FIG. 5 is a side perspective view of the present comb holder with three combs shown mounted.

Another preferred feature of the frame 12 is that each of the elongate beams 22*a*, 22*b* is provided with a plurality of spaced, angled slots 40 having open ends 42 located along an upper beam edge 44. While the angular orientation may change to suit the application, the slots 40 define an angle γ with the upper beam edge 44 of approximately 60°. The dimension of each of the angled slots 40 is calculated to slidingly accommodate a base panel 48 of an associated hair clipper attachment comb 50 (FIG. 5) in a set of such combs.

As is known in the art, and referring now to FIGS. 5 and 7-10, the attachment combs 50 each have a plurality of teeth 52 which are joined at one end to the base panel. To provide the user, operator or stylist a relative indication of the resulting hair length achieved by using a particular attachment comb 50, the combs are typically numbered, with a No. 1 comb having a cutting length of approximately ⅛ inch (3 mm); a No. 2 comb having a cutting length of approximately ¼ inch (6 mm); a No. 3 comb having a cutting length of approximately ⅜ inch (10 mm); a No. 4 comb having a cutting length of approximately ½ inch (13 mm); a No. 5 comb having a cutting length of approximately ⅝ inch (16 mm); a No. 6 comb having a cutting length of approximately ¾ inch (19 mm); a No. 7 comb having a cutting length of approximately ⅞ inch (22 mm); and a No. 8 comb having a cutting length of approximately 1 inch (25 mm). In addition to the above-listed combs 50, the present set of combs 50 includes left and right ear taper combs 50*a* (FIGS. 8 and 9) having teeth 52 with varying lengths for trimming around a subject's ears. An important consideration in selecting the proper slot angle γ is that once the combs 50 are inserted into the slots 40, and the cavities 36 are occupied, identification number or word designations 56 on each comb, typically located on the base panel 48, are visible to the user (best seen in FIG. 10).

To further facilitate user identification of the appropriate comb 50 and placement of the combs on the frame 12, a plurality of spaced comb number identification tabs 58 are provided along each of the elongate beams 22*a*, 22*b*.

Referring now to FIGS. 1, 5, 9 and 10, in the case of the No. 1 comb, due to its small relatively small size, the frame 12 is provided with a slotted tab 60 extending from the first end 14 of the frame. While the precise location of the tab 60 may vary to suit the application, in the preferred embodiment, the tab defines a plane that is aligned with the center beam 28 of the frame 12. The tab 60 is provided with a slot 40 for slidingly accommodating the base panel 46 of the No. 1 comb, and is sufficient for retaining the small comb in place. Also, the tab 60 has an identification tab 58.

Figure 6:
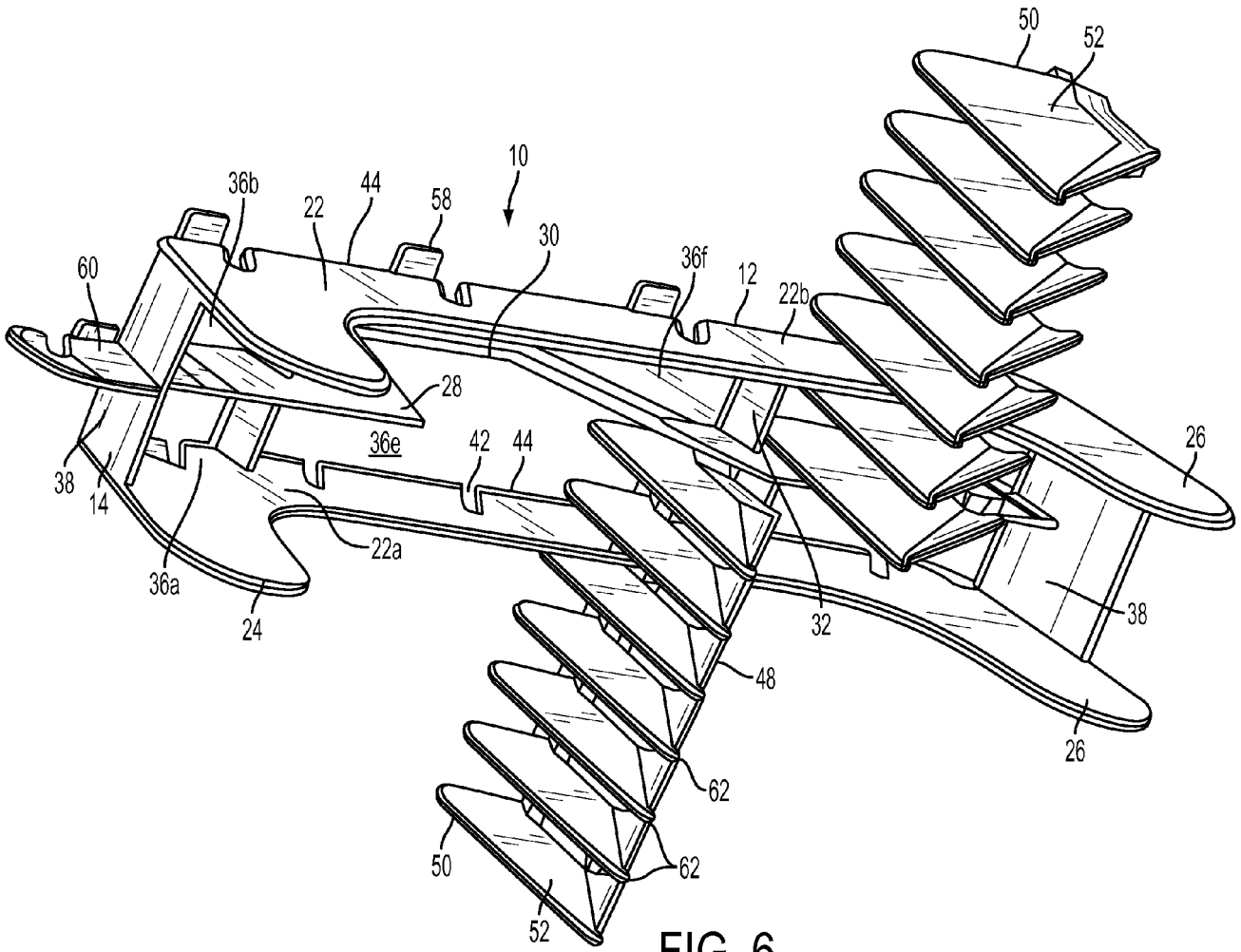
FIG. 6 is a bottom perspective view of the present attachment comb holder with two combs shown installed.
Figure 7:
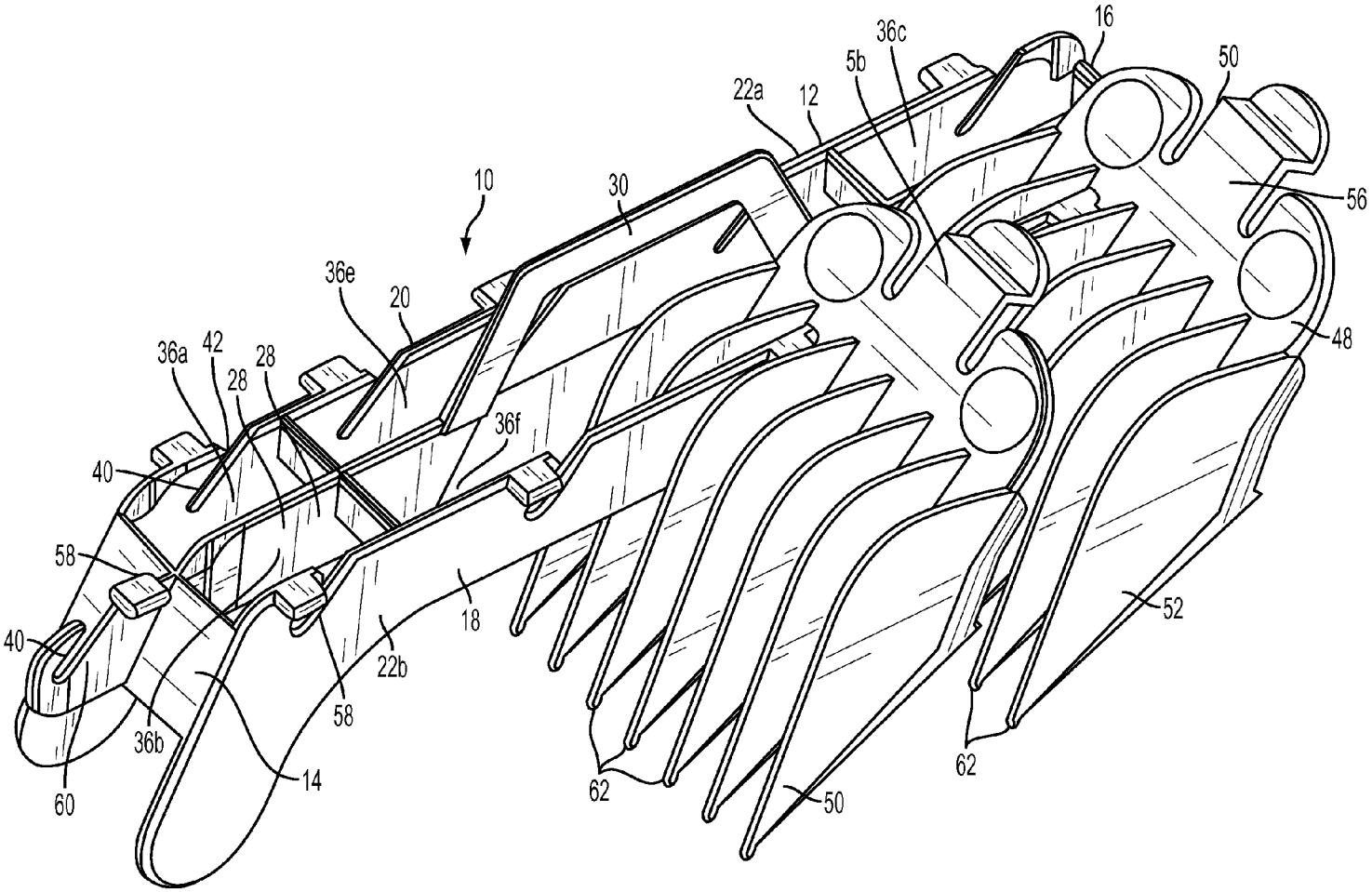
FIG. 7 is a top perspective view of the present attachment comb holder with two combs installed.
Figure 8:
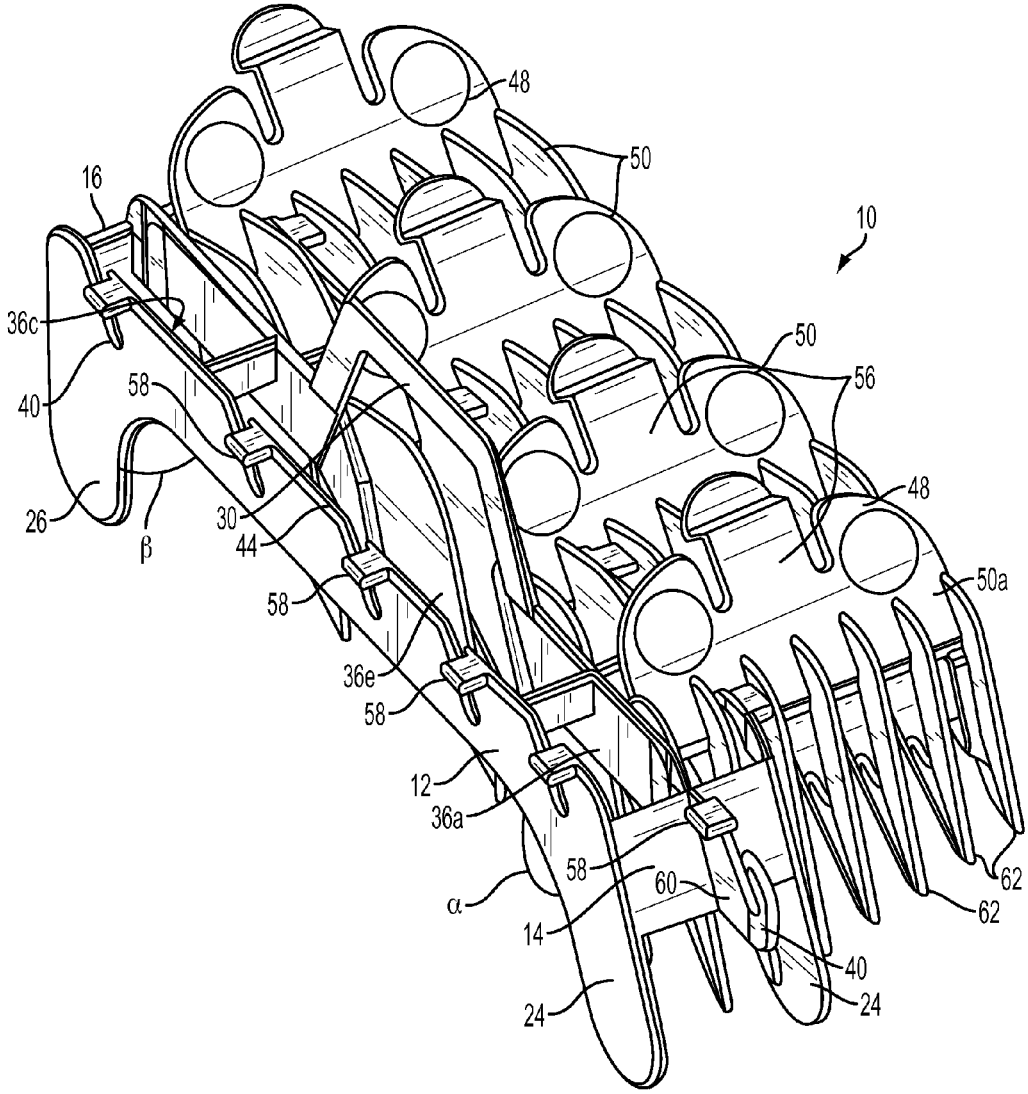
FIG. 8 is a top perspective view of the present attachment comb holder with four combs installed on one side.
Figure 9:
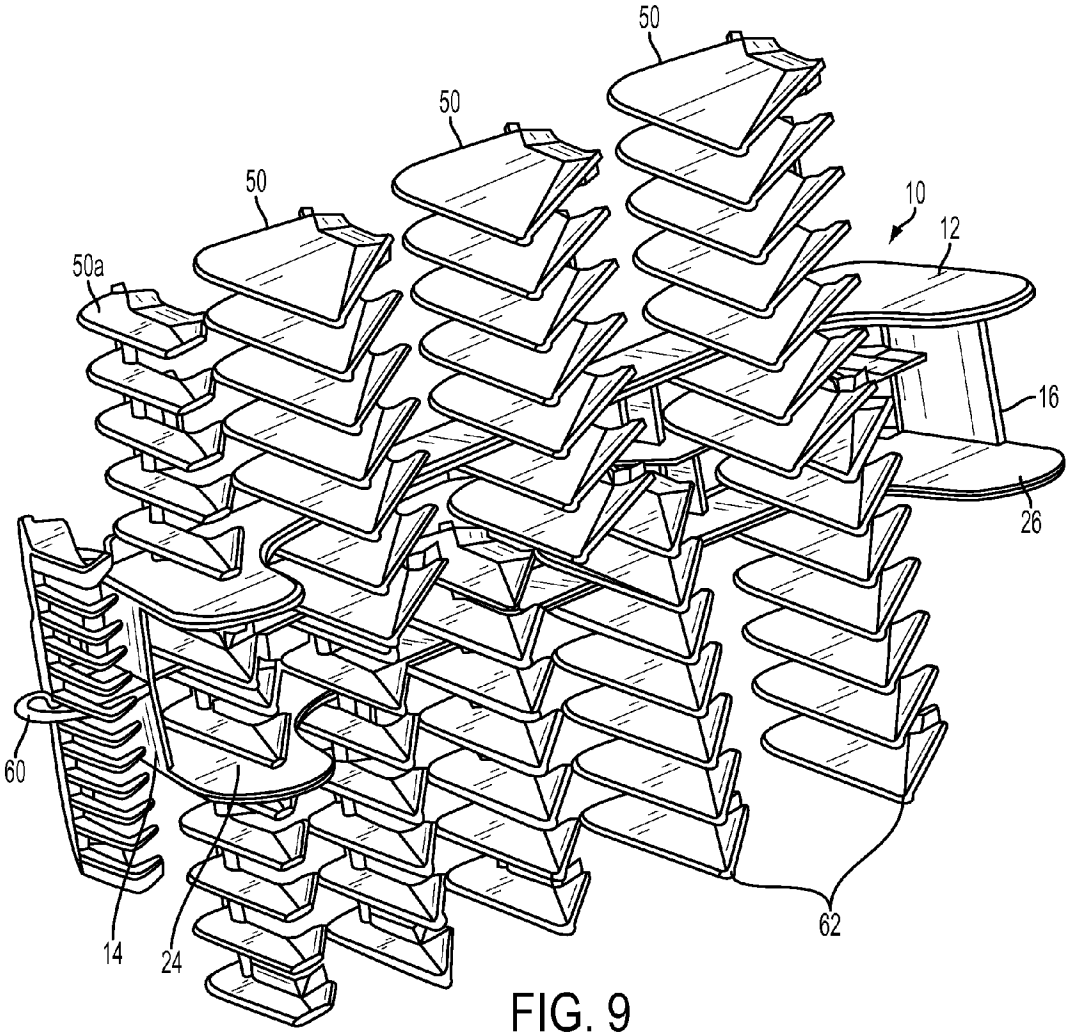
FIG. 9 is a bottom perspective view of the present attachment comb holder with a set of combs installed.
Figure 10:
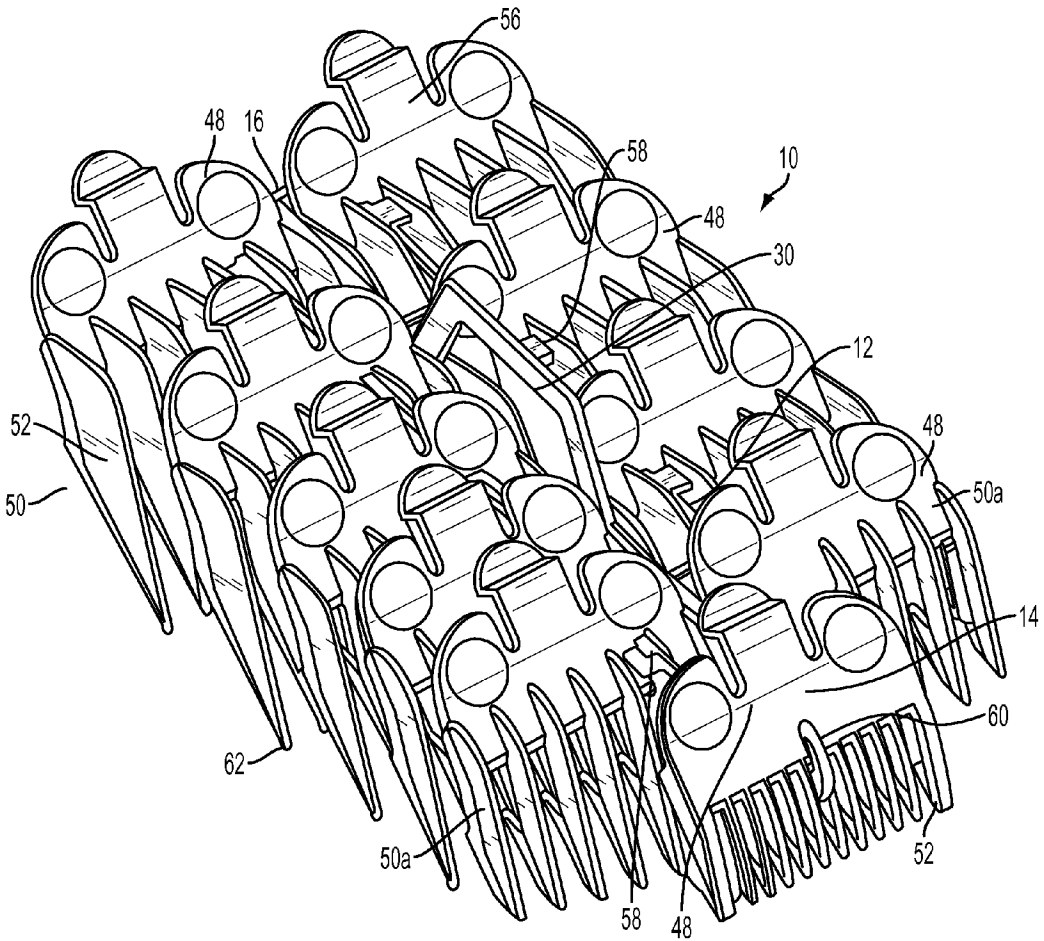
FIG. 10 is a top perspective view of the present attachment comb holder with a set of combs installed.

In the case of the relatively larger combs 50, to stabilize and thus more securely retain the combs on the frame 12, the cavities 36 are constructed and arranged for slidingly accommodating at least one, and preferably two comb teeth 52 of each comb (best seen in FIGS. 6 and 7). Once a plurality of the larger combs 50, such as the Nos. 4-8 combs are fully inserted into the frame 12 so that the teeth 52 are projecting into the cavities 36 and the base panels 48 bottom out in the slots 40, tips 62 of the comb teeth 52 support the frame on a substrate, such as a table or counter. It will also be appreciated that the largest cavities, 36*e*, 36*f* are provided with a pair of slots 40 and as such cavity 36*e* accommodates three combs 50 and 36*f* accommodates two combs. Referring to FIGS. 9 and 10, another advantage of the present comb holder 10 is that ten combs 50 can be carried in an organized fashion in a relatively small, lightweight holder unit. While other lengths are contemplated, in the preferred embodiment, the holder has a length of approximately 6.5 inches (16.25 cm).

While a particular embodiment of the present comb caddy has been shown and described, it will be appreciated by those skilled in the art that changes and modifications may be made thereto without departing from the invention in its broader aspects and as set fourth in the following claims.

What is claimed is:

1. A comb holder for removably holding at least one hair clipper attachment comb, comprising:

a frame including a first end, a second end, a first side, a second side, and having at least two elongate beams each defining one of said sides and spaced from each other;

a plurality of transverse baffles having ends engaging at least one of said beams to define a plurality of open cavities between said beams; and said cavities being constructed and arranged for accommodating at least one tooth of the at least one attachment comb;

wherein said frame includes a center beam located between said two elongate beams, all said beams being in spaced parallel relationship to each other;

said first and second ends of said side beams each have a depending foot formation; and said foot formations at said first end extend at an angle from said corresponding elongate side beam which is distinct from an angle of extension of said foot formations at said second end.

2. The comb holder of claim 1 wherein said baffles separate said center beam respectively from each of said side beams to define said cavities.

3. The comb holder of claim 1 wherein said cavities are respectively dimensioned for slidingly accommodating a pair of teeth of a corresponding one of said combs.

4. The comb holder of claim 1 wherein each said elongate beam is provided with a plurality of spaced, angled slots open along an upper beam edge.

5. The comb holder of claim 4 wherein said slots are angled at approximately 60° relative to said upper beam edge.

6. The comb holder of claim 4 wherein each said slot is dimensioned for slidingly accommodating a base panel of one of the attachment combs.

7. The comb holder of claim 1 further including a slotted tab extending from said front end of said frame.

8. The comb holder of claim 7 wherein said slotted tab defines a plane that is aligned with said center beam of said frame.

9. The comb holder of claim 1 wherein said frame includes an identification number tab for each comb held by said holder.

10. The comb holder of claim 1, further including a handle on said frame.

11. A comb holder for use with a plurality of hair clipper attachment combs, comprising:

a frame including at least two elongate beams with a center beam disposed therebetween, said beams being in spaced, parallel relationship to each other, a plurality of transverse baffles separating said center beam respectively from each of said elongate beams for defining a plurality of open cavities between said center beam and each said elongate beam;

said cavities being constructed and arranged for accommodating at least one tooth of one of the attachment combs; and a plurality of angled slots having open ends along an upper edge of each said elongate beam for accommodating an attachment comb base, wherein each said slot is dimensioned for slidingly accommodating a base panel of one of the attachment combs.

12. A comb attachment set and comb holder assembly, comprising:

a plurality of attachment combs, each having a plurality of teeth attached at one end to a base panel;

a frame including at least two elongate beams with a center beam disposed therebetween, said beams being in spaced, parallel relationship to each other, a plurality of transverse baffles separating said center beam respectively from each of said elongate beams for defining a plurality of open cavities between said center beam and each said elongate beam, said cavities being constructed and arranged for accommodating at least one said tooth of one of said attachment combs; and a plurality of angled slots having open ends along an upper edge of each said elongate beam for accommodating a corresponding said attachment comb base.

13. The comb attachment set and comb holder assembly of claim 12, wherein upon a plurality of said hair clipper attachment combs being located in said appropriate cavities on said frame, tips of said comb teeth support said frame on a substrate.

14. The comb attachment set and comb holder assembly of claim 12, wherein each said comb is provided with an identification number, and said slots and said cavities are constructed and arranged such that when all of said slots are occupied by selected ones of said combs, said identification numbers are visible by a user.

15. The comb attachment set and comb holder assembly of claim 12, further including a slotted tab extending from an end of said frame and being configured for accommodating a No. 1 size comb.

16. A comb holder for removably holding at least one hair clipper attachment comb, comprising:

a frame including a first side, a second side, and having a center beam sandwiched between at least two elongate beams, each elongate beam defining one of said first and second sides and equally spaced from the other of said first and second sides and said center beam; and a plurality of transverse baffles having ends engaging at least one of said beams to define a plurality of open cavities formed between said center beam and said at least two elongate beams, each open cavity being open throughout from a top of said holder to a bottom of said holder such that said beams are supported by said baffles alone;

wherein said cavities are each constructed and arranged for accommodating at least one tooth of the at least one attachment comb.

* * * * *